United States Patent [19]

Kozel

[11] 4,243,289

[45] Jan. 6, 1981

[54] ELECTRICAL MALE CONNECTOR ASSEMBLY

[75] Inventor: Charles A. Kozel, McHenry, Ill.

[73] Assignee: Methode Electronics, Inc., Chicago, Ill.

[21] Appl. No.: 58,540

[22] Filed: Jul. 18, 1979

Related U.S. Application Data

[63] Continuation of Ser. No. 871,341, Jan. 23, 1978, abandoned.

[51] Int. Cl.[3] ..... H01R 13/514

[52] U.S. Cl. ..... 339/126 RS; 339/176 M; 339/206 P; 339/221 M; 339/276 A

[58] Field of Search ..... 339/91 R, 91 M, 176 R, 339/176 M, 176 MP, 221 R, 221 M, 276 A, 17, 18, 119, 125, 198, 214, 206 P, 126 RS

[56] References Cited

U.S. PATENT DOCUMENTS

| | | | |
|---|---|---|---|
| 2,885,651 | 5/1959 | Moeller | 339/198 R |
| 3,001,106 | 9/1961 | Higgs | 339/176 M X |
| 3,535,675 | 10/1970 | Baumanis | 339/125 R |
| 3,579,170 | 5/1971 | Baumanis | 339/91 R X |
| 3,591,834 | 7/1971 | Kolias | 339/17 LMX |
| 3,950,060 | 4/1976 | Stipanuk | 339/91 R |

FOREIGN PATENT DOCUMENTS

| | | | |
|---|---|---|---|
| 1370012 | 10/1974 | United Kingdom | 339/176 M |

*Primary Examiner*—John McQuade
*Assistant Examiner*—John S. Brown
*Attorney, Agent, or Firm*—Charles F. Pigott, Jr.

[57] ABSTRACT

An electrical male connector assembly including a header or male connector having an insulator body member and a plurality of parallel pins which project through opposite sides of the insulator body. The connector includes two separate insulator body members mounted on a common set of parallel pins, and may further include an intermediate mounting member disposed on the same set of pins between the two body members.

8 Claims, 6 Drawing Figures

FIG. 1
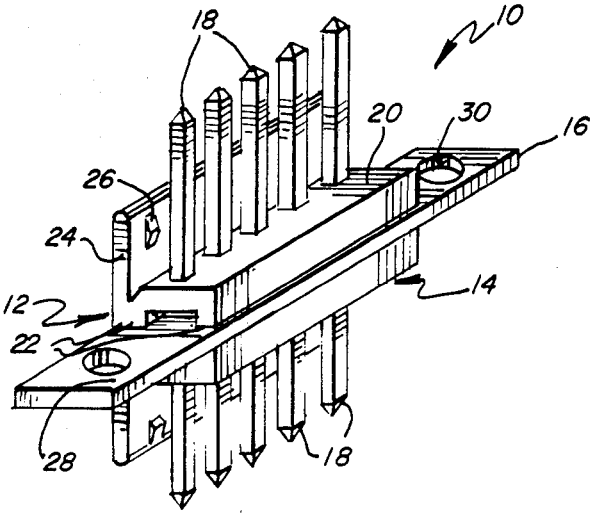
FIG. 2
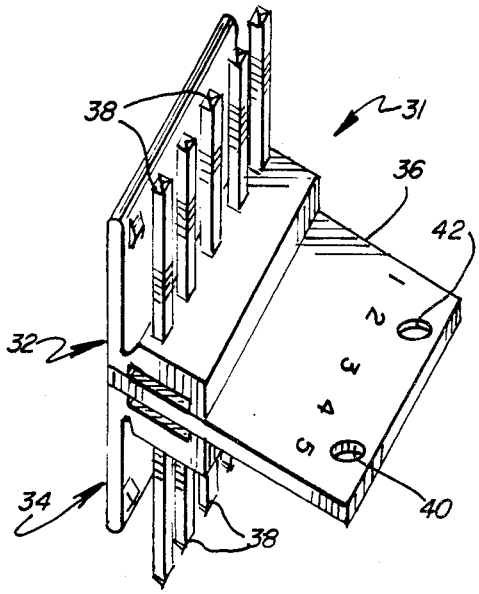
FIG. 3
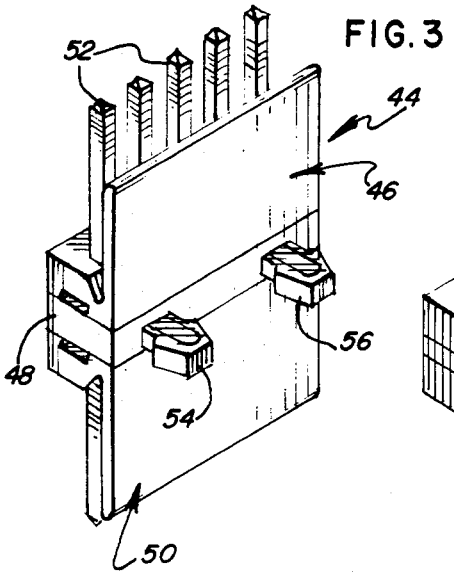
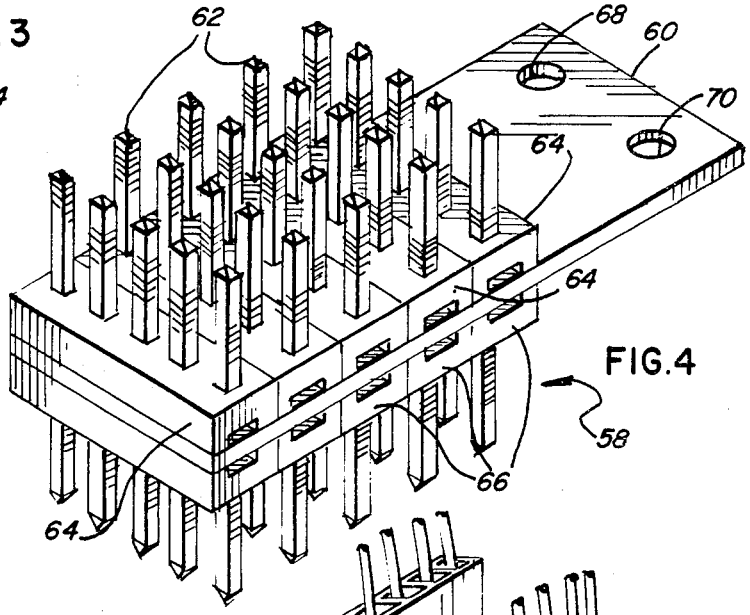
FIG. 4
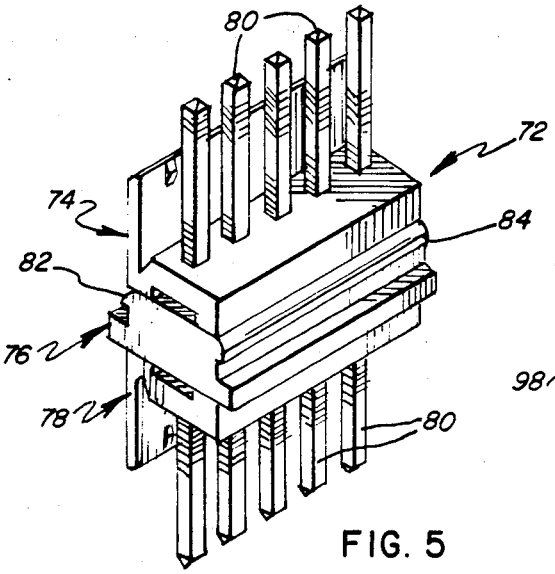
FIG. 5
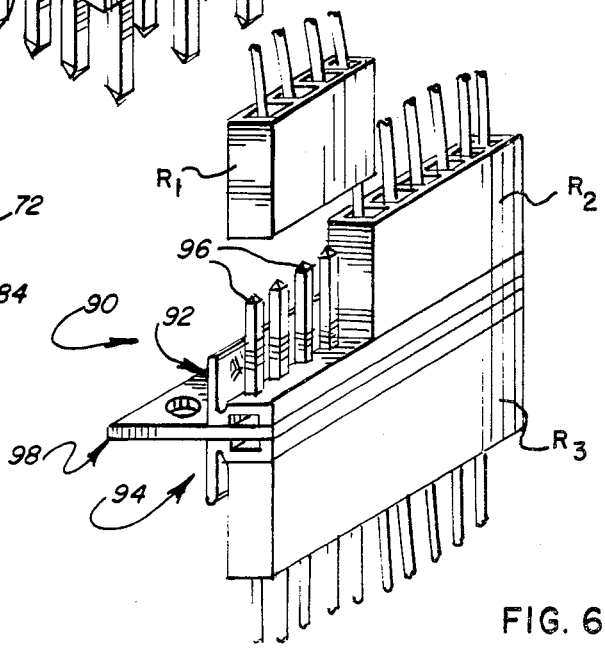
FIG. 6

ELECTRICAL MALE CONNECTOR ASSEMBLY

This is a continuation of application Ser. No. 871,341, filed Jan. 23, 1978 and now abandoned.

BRIEF SUMMARY OF THE INVENTION

The present invention relates to an electrical connector or header member normally used to interconnect a pair of female connector members or used as wire wrap termination posts. Such a header is normally associated with a printed circuit board and may be mounted to such a board and dip soldered thereto, or may be inserted in a mounting slot in a printed circuit board or in a metal plate or panel associated with circuit-containing members.

It is known in the art to provide an electrical connector or header comprising a body member of insulating material such as plastic having a plurality of conductive pins projecting therethrough so as to extend from two opposite sides of the insulator body for the purpose of interconnecting a pair of female connector members. Such an electrical header is assembled by molding a plastic insulator body with a plurality of parallel pin holes therein, and mounting a plurality of conductive metal pins in such holes, the pins being parallel to one another and being retained in the insulator body by friction.

It is an object of the present invention to provide an improved electrical male connector assembly having two header body members mounted on a common set of parallel conductive pins so as to provide a modular connector assembly having applications and advantages not afforded by conventional headers having a single insulator body.

Another object of the invention is to provide an improved electrical male connector assembly as last above-mentioned including a center layer section mounted on the same common set of conductive pins and interposed between the two header body members, the center layer section also being of insulating material such as plastic and serving as a means for mounting the male connector assembly either to a printed circuit board or to a panel or the like.

A further object of the invention is to provide an improved electrical male connector assembly of modular construction comprising a center layer section of insulating material mounted on a plurality of parallel conductive pins, and a plurality of individual header body members mounted on the common set of conductive pins on opposite sides of the center layer section which serves to mechanically interconnect the plurality of header body members as well as to mount the male connector assembly.

The foregoing and other objects and advantages of the invention will be apparent from the following description of certain preferred embodiments, taken in conjunction with the accompanying drawings.

DESCRIPTION OF THE DRAWINGS

FIG. 1 is a perspective view of an electrical male connector assembly constructed in accordance with the present invention and having a pair of header body members mounted on a common set of parallel conductive pins with a center layer section interposed between the body members;

FIG. 2 is a perspective view of an alternative embodiment of the invention illustrating a different type of center layer section interposed between the pair of header body members;

FIG. 3 is a perspective view of a third embodiment of the invention illustrating a pair of header body members having a center layer section therebetween which includes a pair of flexible locking legs for mounting the male connector assembly to a printed circuit board or the like;

FIG. 4 is a perspective view of a fourth embodiment of the invention illustrating an electrical male connector assembly of modular construction having a center layer section with a plurality of header body members mounted on a common set of pins on opposite sides of the center layer section;

FIG. 5 is a perspective view of a fifth embodiment of the invention showing a male connector assembly having a center layer section with locking means formed thereon for snapping into a slot formed in a circuit board or panel member; and FIG. 6 is a perspective view of an electrical male connector assembly similar to that of FIG. 2 illustrating the attachment of crimped contact receptacles of various sizes to opposite sides of the assembly.

Now, in order to acquaint those skilled in the art with the manner of making and using my invention, I shall describe, in conjunction with the accompanying drawings, certain preferred embodiments of my invention.

DETAILED DESCRIPTION OF THE INVENTION

Referring now to the drawings, and in particular to FIG. 1, there is shown an electrical male connector assembly 10 comprising a first header body member 12 of insulating material such as plastic, a second header body member 14, a center layer section 16 of insulating material, and a plurality of electrically conductive metal pins 18. The body member 12 includes a base portion 20 having flat coplanar bottom surfaces 22, and an upright backwall 24 integral with the base portion and generally perpendicular thereto. A plurality of small projections as shown at 26 are formed on the backwall 24 on the side facing the pins 18 for locking with a female connector member. That is, when a female connector (see FIG. 6) is plugged on to the upper ends of the pins 18, an insulator body or housing of the female connector will be disposed immediately adjacent the backwall 24, and a small recess or groove formed in the female body member will therefore receive the projections 26 to achieve releasable locking relation with the body member 12.

The second header body member 14 may be identical to the body member 12 and thus will not be separately described herein. The conductive pins 18 are shown as being square in cross-section, with tapered ends, although it will be understood with respect to all of the embodiments described herein that round pins may be used in the male connector assembly of the present invention. In the embodiment of FIG. 1, the center layer section 16 comprises a flat elongated plate member having holes 28 and 30 at opposite ends thereof for mounting the connector assembly 10 in a fixed position on a panel or the like.

In constructing the male connector assembly 10, a first header body such as the body member 12 is assembled to the plurality of pins 18, it being understood that the body member has a plurality of square openings through which the pins are inserted. After assembly of the first body member 12 with the plurality of pins 18, the center layer section 16, which is also provided with a similar plurality of pin openings, is assembled on the pins, and finally the second body member is forced on to the pins. The three members 12, 14 and 16 are forced together with the center layer section held in between the two body members as shown in FIG. 1. It is important to understand that each of the three components 12, 14 and 16 is provided with a similar plurality of square pin openings to receive the pins 18, and the openings are dimensioned to provide a relatively tight friction fit. In the foregoing manner, the components as illustrated in FIG. 1 are held together by friction without need for adhesive or other retaining means.

FIG. 2 shows an embodiment similar to FIG. 1 comprising a male connector assembly 31, first and second header body members 32 and 34 and a center layer section 36, the foregoing three components being mounted on a common set of conductive pins 38 and held thereon by friction. The center layer section 36 comprises a flat plate-like member of insulating material having a pair of mounting holes 40 and 42 formed therein. In this embodiment, the center layer plate member 36 extends transversely relative to the connector assembly, whereas in the embodiment of FIG. 1 the center plate member extends longitudinally relative to the connector assembly. It will be noted that the center mounting plate member 36 of FIG. 2 may have legend information printed thereon to identify the function, current or voltage characteristics of the individual pins 38.

FIG. 3 illustrates a further embodiment of the invention comprising a male connector assembly 44 including a first header body member 46, a center layer section 48, a second header body member 50, and a plurality of conductive pins 52. The two body members 46 and 50 and the center layer section 48 are assembled together on the common set of conductive pins 52 in the manner previously described and held in assembled relation by friction. In this embodiment, the center layer section 48 comprises an elongated flat plate-like member having a pair of locking legs 54 and 56 formed integral therewith. The locking legs 54 and 56 are flexible and designed to snap into rectangular slots formed in a bulkhead or chassis, whereby the male connector assembly 44 may be mounted to such a bulkhead with the conductive pins 52 parallel thereto.

FIG. 4 illustrates a further embodiment of the invention comprising a male connector assembly 58 including a center layer member 60 through which project a plurality of conductive pins. In this particular embodiment, there are shown twenty-five pins 62 arranged in parallel rows of five each, and of course a similar pattern of square pin openings are formed in the center section 60 to receive the pins in a relatively tight friction fit. On the upper side of the center section 60, there are provided five separate header body members 64. Each of the body members comprises an elongated block-like member having five rectangular pin openings, and each such member is mounted on a corresponding row of five of the pins 62. The several body members 64 are assembled in parallel side-by-side manner on one side of the center plate 60, and a similar group of five header body members 66 are mounted on corresponding rows of the pins 62 on the opposite side of the center plate 60. As in the other embodiments described herein, each of the components 60, 64 and 66 is provided with square pin openings dimensioned to provide a relatively tight friction fit when the pins 62 are pressed therethrough, whereby such components may be held in assembled relation by friction without need for adhesive or other retaining means. The center plate member 60 is provided with a pair of mounting holes 68 and 70 for mounting the male connector assembly.

Reference is now made to FIG. 5 which illustrates still another embodiment of the present invention comprising a male connector assembly 72. The connector assembly 72 includes a first header body member 74, a center layer section 76, a second header body member 78, and a plurality of conductive pins 80. The foregoing components 74, 76 and 78 are assembled in the manner previously described herein, each being provided with a plurality of square pin openings to receive the pins 80 in a relatively tight friction fit. In addition, the center layer section 76 is provided on opposite sides thereof with locking projections 82 and 84. The locking projections are elongated so as to extend the full length of the center section, and such projections are designed to cooperate with opposite sides of a slot opening to permit the center layer to be snapped into a rectangular slot and retained therein for mounting the male connector assembly on a printed circuit board or panel or the like. It will further be understood that if the mounting slot is longer than the length of the center layer 76, the mounted connector assembly 72 may be moved along the slot so as to be movable relative to the member on which it is mounted.

It will now be understood that the present invention contemplates the combination of two header body members on a common set of conductive pins, preferably in combination with a center layer member which includes means for mounting the assembly. However, it should be noted that two header body members, as shown for example at 12 and 14 in FIG. 1, may be combined on a common set of conductive pins without a center layer therebetween, and still afford advantages over a conventional header with a single body member. In such a combination, each of the body members may be provided with a plurality of "ramp and snap lock" type protrusions as shown at 26 in FIG. 1 to permit female connector body members to be connected to opposite sides of the header assembly and snap-locked thereto (see FIG. 6).

In each of the embodiments described herein, the conductive pins of the male connector assembly may either mate with female connection contacts, or serve as wire wrap termination posts. In the embodiments of FIGS. 1, 2 and 4, the center layer section includes mounting holes to permit the assembly to be used as a "flying" connection to be anchored at any desired location. FIGS. 3 and 5 represent two examples of a bulkhead fixed arrangement where the center layer has locking means permitting the assembly to be snapped and locked into an opening or openings in a bulkhead or chassis. FIG. 3 illustrates an arrangement where the assembly is mounted with the conductive pins parallel to the bulkhead or chassis on which the assembly is mounted, whereas FIGS. 1, 2, 4 and 5 illustrate assemblies which can be mounted on a bulkhead or chassis with the conductive pins at right angles thereto.

It is clearly an advantage of the present invention that it permits the use of conventional header body members in combination with a selected type of center layer section, and such a modular male connector assembly permits great flexibility in producing a connector assembly having certain desired characteristics.

It will further be understood that in certain of the embodiments it may be desirable to use a plurality of center layer sections. For example, in the embodiment of FIG. 3, the locking legs 54 and 56 are mounted on a common center layer section 48, but if desired the legs can be mounted on separate spaced coplanar center layer sections. Preferably, any such separate center layer section should be large enough to have at least two of the conductive pins pass therethrough.

FIG. 6 illustrates an electrical male connector assembly 90 similar to that illustrated in FIG. 2 and comprising first and second header body members 92 and 94 assembled on a plurality of parallel conductive pins 96 on opposite sides of a center layer section 98. There are further shown three crimped contact receptacles $R_1$, $R_2$ and $R_3$, the receptacles $R_1$ and $R_2$ being connected to one side of the assembly, and the receptacle $R_3$ being connected to the opposite side. It will thus be understood that receptacles of various sizes may be connected to opposite sides of the connector assembly, there being shown a ten-pin source of different electrical potentials coming to one side of the connector assembly through $R_3$, which are taken off on the other side of the connector assembly through one four-pin connector $R_1$ and one six-pin connector $R_2$, as where the harnesses are desired to go to different locations.

What is claimed is:

1. An electrical male connector assembly comprising, in combination, a first header body member of insulating material having a plurality of pin openings therein, a plurality of rigid electrically conductive parallel pins extending through said first header body member, a center layer section of insulating material having a plurality of pin openings therein, said center layer section being mounted on said plurality of pins adjacent said first header body member, and a second header body member of insulating material having a plurality of pin openings therein, said second header body member being mounted on said plurality of pins adjacent said center layer section on a side opposite said first body member whereby said first and second body members are disposed on opposite sides of said center layer section and held together in assembled relation at least in part by a frictional fit with said common set of conductive pins, said conductive pins being of a length substantially greater than the thickness of said first and second body members and said center layer section and being positioned relative to said first and second body members so as to project substantially beyond the outer surfaces of both of said first and second body members for mating with female connection contacts or to serve as wire wrap termination posts, and mounting means on said center layer section for mounting said male connector assembly.

2. An electrical male connector assembly as defined in claim 1 where said center layer section comprises a substantially flat member perpendicular to said plurality of conductive pins and larger than said first and second body members so as to project beyond the ends of said body members, and at least one mounting hole formed in a projecting portion of said center layer section.

3. An electrical male connector assembly as defined in claim 2 where said center layer section projects longitudinally beyond said first and second body members at least at one end thereof, said center layer section having a mounting hole formed in a longitudinally projecting portion thereof.

4. An electrical male connector assembly as defined in claim 2 where said center layer section projects laterally relative to said first and second body members, said center layer section having at least one mounting hole formed in a laterally projecting portion thereof.

5. An electrical male connector assembly as defined in claim 1 where said center layer section comprises at least one substantially flat member perpendicular to said plurality of conductive pins and having at least one locking leg integral therewith, said locking leg being generally parallel to the plane of said center layer section and perpendicular to said plurality of conductive pins.

6. An electrical male connector assembly as defined in claim 1 where said center layer section comprises a substantially flat member perpendicular to said plurality of conductive pins, said substantially flat member having locking projections along opposite longitudinal edges thereof to permit said center layer section to be snapped into a rectangular slot in a mounting member on which said male connector assembly is to be mounted with said plurality of conductive pins perpendicular to said mounting member.

7. An electrical male connector assembly as defined in claim 1 where a plurality of first body members are mounted on a plurality of pins on one side of said center layer section and a plurality of second body members are mounted on a plurality of pins on the opposite side of said center layer section.

8. An electrical male connector assembly as defined in claim 3 where said center layer section projects longitudinally beyond said first and second body members at two opposite ends thereof, and a mounting hole is formed in each of the two longitudinally projecting portions of said center layer section.

* * * * *